US009068772B2

(12) United States Patent
Yeo et al.

(10) Patent No.: US 9,068,772 B2
(45) Date of Patent: Jun. 30, 2015

(54) DOOR FOR REFRIGERATOR AND REFRIGERATOR HAVING THE SAME

(71) Applicant: LG Electronics Inc., Seoul (KR)

(72) Inventors: Insun Yeo, Gyeongsangnam-Do (KR); Seonkyu Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 215 days.

(21) Appl. No.: 13/761,482

(22) Filed: Feb. 7, 2013

(65) Prior Publication Data

US 2013/0207530 A1 Aug. 15, 2013

(30) Foreign Application Priority Data

Feb. 10, 2012 (KR) ..... 10-2012-0013915

(51) Int. Cl.
*A47B 96/04* (2006.01)
*F25D 23/02* (2006.01)
*F25D 23/12* (2006.01)

(52) U.S. Cl.
CPC ..... *F25D 23/028* (2013.01); *F25D 23/126* (2013.01)

(58) Field of Classification Search
CPC ..... F25D 23/126; F25D 23/028
USPC ..... 312/405
See application file for complete search history.

(56) References Cited

U.S. PATENT DOCUMENTS

| | | | | |
|---|---|---|---|---|
| 7,201,005 | B2 | 4/2007 | Voglewede | |
| 7,340,915 | B2 * | 3/2008 | Kwon | 62/398 |
| 8,151,595 | B2 | 4/2012 | Kim | |
| 8,336,331 | B2 * | 12/2012 | Kim | 62/446 |
| 8,408,665 | B2 * | 4/2013 | Lim | 312/405 |
| 8,517,484 | B2 * | 8/2013 | Eckartsberg et al. | 312/405.1 |
| 2004/0182103 | A1 | 9/2004 | Jung | |
| 2009/0308096 | A1 | 12/2009 | Kim | |
| 2010/0031580 | A1 * | 2/2010 | Lee et al. | 49/504 |
| 2010/0072870 | A1 * | 3/2010 | Hwang | 312/405 |
| 2010/0259147 | A1 * | 10/2010 | Koo | 312/405 |
| 2010/0270901 | A1 * | 10/2010 | Kim et al. | 312/405 |

(Continued)

FOREIGN PATENT DOCUMENTS

| | | |
|---|---|---|
| CN | 1707205 A | 12/2005 |
| CN | 1757997 A | 4/2006 |

(Continued)

OTHER PUBLICATIONS

Korean Office Action dated Oct. 21, 2013 for Application No. 10-2012-0013915, 3 pages.

(Continued)

*Primary Examiner* — Daniel J Troy
*Assistant Examiner* — Timothy M Ayres
(74) *Attorney, Agent, or Firm* — Fish & Richardson P.C.

(57) ABSTRACT

A door for a refrigerator and a refrigerator having the same are provided. The door includes an upper door member disposed in an upper portion and a lower door member disposed under the upper door member and spaced apart from the upper door member. The door also includes a dispenser housing positioned between the upper door member and the lower door member and inwardly depressed to allow a dispenser having a discharge duct for discharging water and/or ice to be installed therein. The door further includes a coupling member that couples the dispenser housing to the upper door member or the lower door member.

14 Claims, 7 Drawing Sheets

(56) References Cited

U.S. PATENT DOCUMENTS

| | | | | |
|---|---|---|---|---|
| 2011/0023524 | A1* | 2/2011 | Roo | 62/389 |
| 2011/0083463 | A1* | 4/2011 | Eckartsberg et al. | 62/389 |
| 2011/0089790 | A1* | 4/2011 | Lee et al. | 312/109 |
| 2012/0017629 | A1* | 1/2012 | Shin | 62/389 |
| 2012/0326587 | A1* | 12/2012 | Jeong et al. | 312/405 |

FOREIGN PATENT DOCUMENTS

| | | | |
|---|---|---|---|
| CN | 101131292 | A | 2/2008 |
| CN | 101460798 | A | 6/2009 |
| CN | 101625188 | A | 1/2010 |
| EP | 1 607 700 | B1 | 1/2010 |
| JP | 2000-088444 | A | 3/2000 |
| KR | 10-2006-0133763 | A | 12/2006 |
| KR | 10-0880198 | A | 1/2009 |
| KR | 10-2012-0004012 | A | 1/2012 |
| WO | WO 2007/142446 | A1 | 12/2007 |
| WO | WO 2011/081499 | A2 | 7/2011 |

OTHER PUBLICATIONS

Chinese Office Action dated Sep. 15, 2014 for Chinese Application No. 201310049107.0, with English Translation, 15 pages.

Korean Office Action dated Apr. 30, 2013 for Application No. 10-2012-0013915, 3 pages.

* cited by examiner

DOOR FOR REFRIGERATOR AND REFRIGERATOR HAVING THE SAME

CROSS-REFERENCE TO RELATED APPLICATION

The present application claims priority to Korean Application No. 10-2012-0013915, filed on Feb. 10, 2012, which is herein expressly incorporated by reference in its entirety.

FIELD

The present disclosure relates to a door of a refrigerator and a refrigerator having the same.

BACKGROUND

A refrigerator is an appliance for keeping food items in storage in a low temperature state for a long period of time by generating cold air using a refrigerating cycle installed and supplying generated cold air to the interior of a refrigerating chamber and/or a freezing chamber.

Refrigerators may include a dispenser for dispensing ice or water without opening a door thereof. Since a dispenser dispenses water or ice without having to open the door of the refrigerator, cold air within the refrigerator does not leak to the outside during dispensing and user convenience may be enhanced.

Refrigerators may further include an ice dispensing device for dispensing ice made in an ice maker without having to open a refrigerator door. The ice dispensing device may keep a large amount of ice cubes in storage in an ice bucket as a storage chamber. When a user provides input to cause ice dispensing, a predetermined amount of ice is dispensed.

FIG. 1 illustrates an example refrigerator including a dispenser and FIG. 2 illustrates an example refrigerator including a dispenser housing installed therein. As illustrated in FIGS. 1 and 2, a refrigerator body 1 includes a refrigerating chamber and a freezing chamber.

In this example, the refrigerating chamber is a vertical space arranged in a vertical direction. Food items are stored in the refrigerating chamber at a low temperature by cold air generated by an evaporator. A plurality of shelves are horizontally installed between wall surfaces of the refrigerating chamber. A freezing chamber is defined as a vertical space next to the refrigerating chamber, in which a temperature is maintained to below 0° Celsius. The refrigerating chamber and the freezing chamber are divided horizontally by a barrier.

Namely, the refrigerating chamber is installed in the right side and the freezing chamber is installed in the left side. Doors 10 and 20 are installed in front side of the refrigerating chamber and the freezing chamber, respectively, and have a configuration including an outer door case 13 made of steel forming the exterior decor and an inner case made of a synthetic resin and installed to be spaced apart from the outer door case 13.

In addition, pigment, such as paint, or the like, is painted on a surface of the outer door case 13 to prevent a steel surface of the outer door case 13 from being exposed or tempered glass is attached to the surface of the outer door case 13. In this case, sponge, or the like, serving as a buffer may be inserted between the outer door case 13 and the tempered glass.

An insulator is provided in a space between the outer door case 13 and the inner case to insulate the refrigerating chamber with respect to the outside. A handle may be provided on a surface of the outer door case 13. The handle is installed to substantially open and close the doors 10 and 20. The doors 10 and 20 are rotated by hinges installed in left and right end portions of the refrigerator body 1 to open and close the refrigerating chamber and the freezing chamber.

A dispenser housing 30 is positioned on a front surface of the freezing chamber door 10. The dispenser housing 30 is inserted in a dispenser insertion hole 15 as a through hole defined in a middle portion of the outer door case 13, of the freezing chamber door 10, as one body. A dispenser including the dispenser housing 30 dispenses water or ice such that the user does not need to open or close the refrigerator door.

As illustrated in FIG. 2, the dispenser housing 30 is depressed backwardly and inserted into the dispenser insertion hole 15 penetrating the outer door case 13 of the freezing chamber door 10. The dispenser housing 30 is inserted into the dispenser insertion hole 15 and subsequently attached to the outer door case 13 of the freezing chamber door 10 by an adhesive or a foaming agent C along the edges thereof. Paint or tempered glass is installed on a front surface of the outer door case 13 of the freezing chamber door 10.

SUMMARY

In one aspect, a door for a refrigerator includes an outer door case, a door liner coupled to an inner side of the outer door case, and an insulator positioned in a space between the outer door case and the door liner. The outer door case includes an upper door member that includes a first metal plate of a first color, a lower door member that includes a second metal plate of the first color, and a dispenser housing that includes a third metal plate of the first color. The outer door case also includes an upper connection member that is made of synthetic resin and that connects the upper door member and the dispenser housing and a lower connection member that is made of synthetic resin and that connects the lower door member and the dispenser housing.

Implementations may include one or more of the features described herein. For example, the upper connection member may include a first housing coupling portion that is provided in a lower portion of the upper connection member and that is configured to couple to the dispenser housing. In this example, the upper connection member may include a display unit configured to display at least one of dispensing information and information related to operation of the refrigerator and an input unit configured to receive user input that controls at least one of dispensing operation and operation of the refrigerator. In addition, the first housing coupling portion may include a discharge duct from which at least one of water and ice is dispensed.

In some implementations, the lower connection member may include a second housing coupling portion configured to couple to a lower portion of the dispenser housing. In these implementations, the second housing coupling portion may include a residual water receiving portion that is depressed downwardly and configured to collect residual water of the dispenser.

In some examples, surfaces of the upper door member and the upper connection member and surfaces of the lower door member and the lower connection member may be configured to be disposed in the same vertical plane. In these examples, the upper door member may have a first coupling step that is positioned in a lower end portion thereof and that is inwardly bent, the dispenser housing may have a second coupling step that is positioned in an upper end portion thereof and that is inwardly bent, an upper edge of the upper connection member may insert into the first coupling step, and a lower edge of the upper connection member may insert into the second coupling step.

Further, the lower door member may have a third coupling step that is positioned in an upper end portion thereof and that is inwardly bent, the dispenser housing may have a fourth coupling step that is positioned in an lower end portion thereof and that is inwardly bent, a lower edge of the lower connection member may insert into the third coupling step, and an upper edge of the upper connection member may insert into the fourth coupling step. The dispenser housing may include an actuator pad configured to receive input that controls dispensing of ice or water.

In another aspect, a door for a refrigerator includes a first door member positioned in an uppermost portion of the door and having a flat front vertical plane. The door also includes a second door member positioned in a middle portion of the door and having an inwardly depressed and bent vertical plane. The door further includes a dispenser installed in the second door member and configured to dispense at least one of water and ice. The second door member serves as a dispenser housing. In addition, the door includes a third door member positioned in a lowermost portion of the door and having a flat front vertical plane. The first door member, the second door member, and the third door member define an outer door case and have been fabricated at the same time by performing pressing on a single member in a single mold.

Implementations may include one or more of the features described herein. For example, the first door member, the second door member, and the third door member may be made of the same stainless material.

In yet another aspect, a refrigerator includes a refrigerator body that defines a refrigerating chamber and a freezing chamber, a refrigerating chamber door configured to open and close the refrigerating chamber, and a freezing chamber door configured to open and close the freezing chamber. The freezing chamber door includes an outer door case, a door liner coupled to an inner side of the outer door case, and an insulator positioned in a space between the outer door case and the door liner. The outer door case includes an upper door member that includes a first metal plate of a first color, a lower door member that includes a second metal plate of the first color, and a dispenser housing that includes a third metal plate of the first color. The outer door case also includes an upper connection member that is made of synthetic resin and that connects the upper door member and the dispenser housing and a lower connection member that is made of synthetic resin and that connects the lower door member and the dispenser housing.

Implementations may include one or more of the features described herein. For example, the upper door member, the lower door member, and the dispenser housing may be made of the same stainless material. Also, the upper connection member may include a first housing coupling portion that is provided in a lower portion of the upper connection member and that is configured to couple to the dispenser housing.

In some implementations, the lower connection member may include a second housing coupling portion configured to couple to a lower portion of the dispenser housing. In these implementations, the second housing coupling portion may include a residual water receiving portion that is depressed downwardly and configured to collect residual water of the dispenser.

In some examples, surfaces of the upper door member and the upper connection member and surfaces of the lower door member and the lower connection member may be configured to be disposed in the same vertical plane. In these examples, the upper door member may have a first coupling step that is positioned in a lower end portion thereof and that is inwardly bent and the dispenser housing may have a second coupling step that is positioned in an upper end portion thereof and that is inwardly bent. Further, in these examples, an upper edge of the upper connection member may insert into the first coupling step and a lower edge of the upper connection member may insert into the second coupling step.

In addition, the lower door member may have a third coupling step that is positioned in an upper end portion thereof and that is inwardly bent and the dispenser housing may have a fourth coupling step that is positioned in an lower end portion thereof and that is inwardly bent. A lower edge of the lower connection member may insert into the third coupling step and an upper edge of the upper connection member may insert into the fourth coupling step.

DETAILED DESCRIPTION

Figure 1:
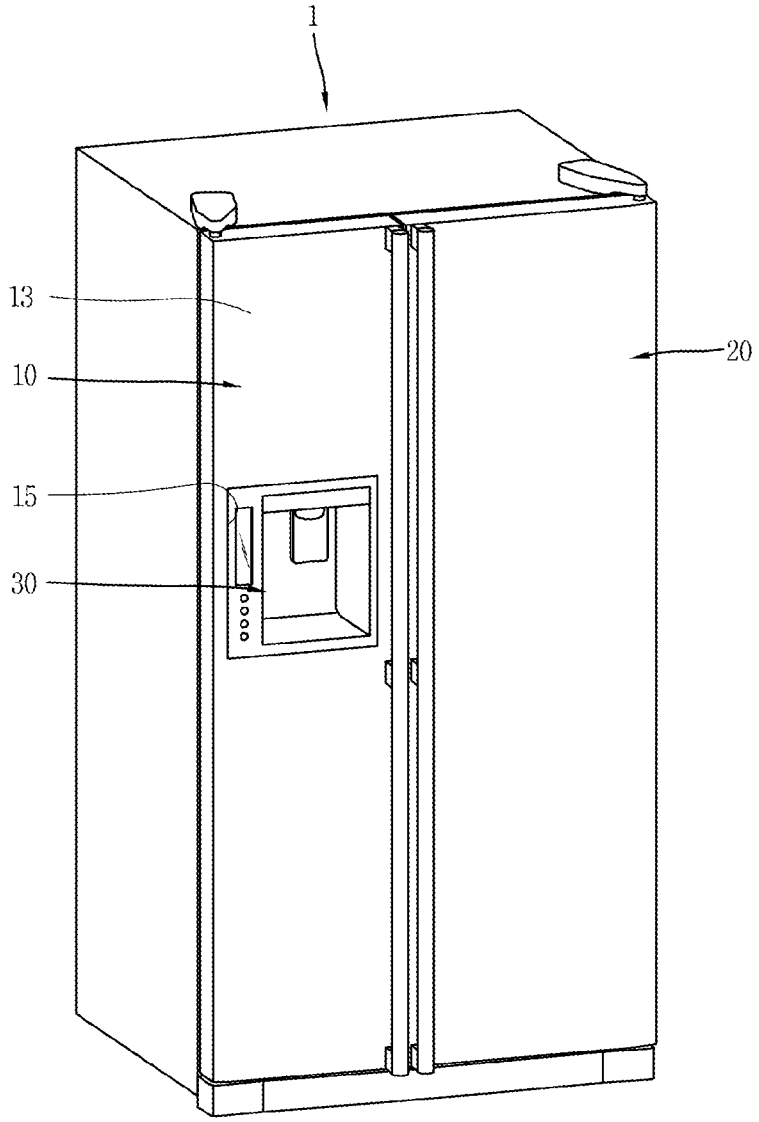
FIG. 1 RELATED ART
FIGS. 1 and 2 are a perspective view and a coupling view illustrating an example related art refrigerator door.
Figure 2:
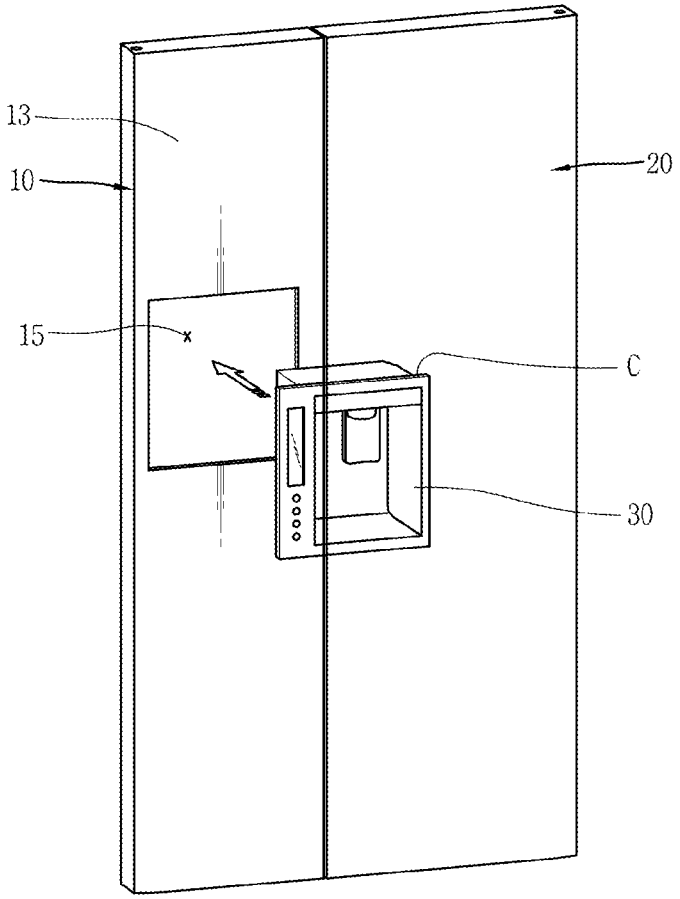
FIG. 2 RELATED ART

As illustrated in FIGS. 1 and 2, in the freezing chamber door 10 of an example related art refrigerator, a foaming agent is provided between the outer door case 13 and the inner case in the process of manufacturing, and tempered glass is attached to the front surface of the outer door case 13. The tempered glass may be fabricated to have various colors and tempered glass having a desired color is selected according to consumers' demand.

The dispenser insertion hole 15 is defined in a middle portion of the outer door case 13 of the freezing chamber door 10, and the dispenser housing 30 is depressed and inserted into the dispenser insertion hole 15. The dispenser housing 30 may have the same color as that of the outer door case 13 made of steel.

As illustrated in FIG. 2, the dispenser housing 30 is inserted into the dispenser insertion hole 15 and buried in the outer door case 13 by a foaming agent or an adhesive (C). As a result, in the example related art refrigerator in which the outer door case 13 of the freezing chamber door 10 is a single member and the dispenser is provided to the outer door case 13, the outer door case 13 is separately punched. In this case, the outer door case 13 is punched such that a size thereof is equal to that of the dispenser housing 30, which requires precision of the punching operation.

Since the dispenser housing 30 is inserted in the dispenser insertion hole 15 and coupled by a foaming agent or an adhesive, a finishing process may not be neatly performed or the refrigerator door 10 may be contaminated by foreign objects, or the like. In addition, after the refrigerator is used for a long period of time, the function of the foaming agent or the adhesive may be degraded so the dispenser housing 30 may be released from the outer door case 13.

Figure 3:
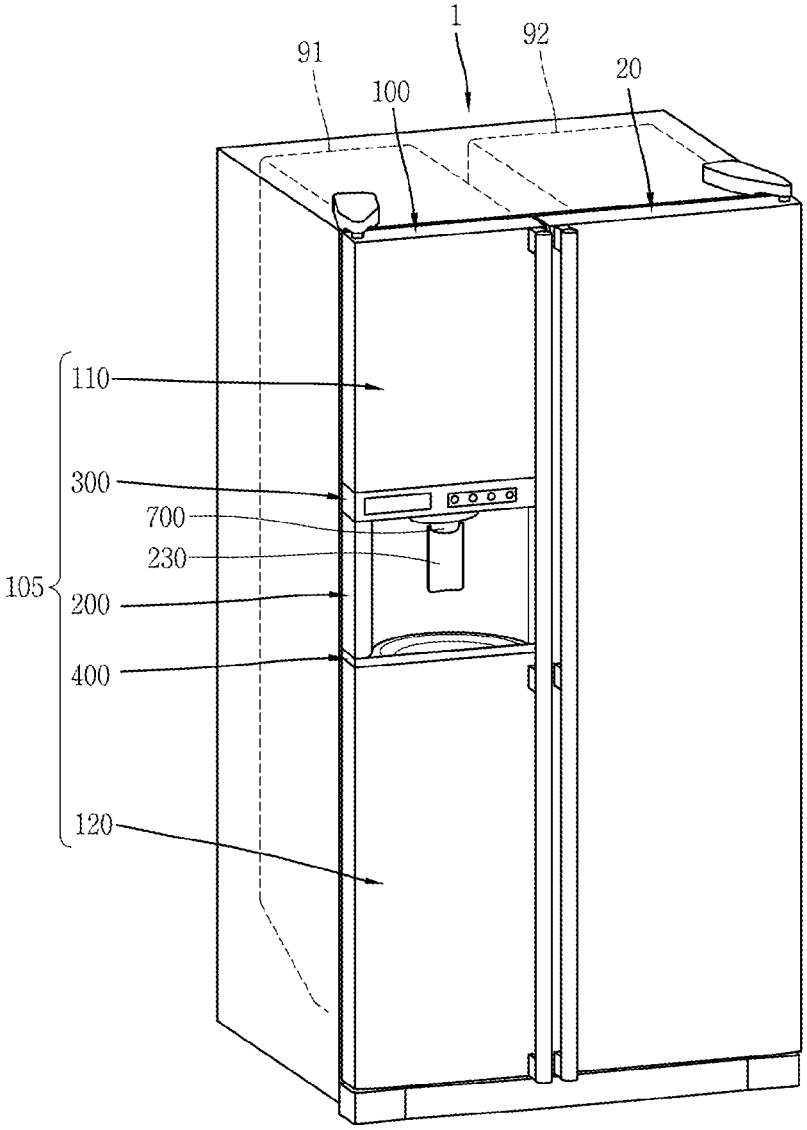
FIG. 3 is a perspective view illustrating an example door for an example refrigerator.

In the example refrigerator door shown in FIG. 3, the dispenser insertion hole of the outer door case is eliminated, and a three-stage assembly including an upper door member, a lower door member, and a dispenser housing is used. The three-stage assembly may improve an assembling structure of the freezing chamber door and may result in a refrigerator door having a fine view in the exterior.

Figure 4:
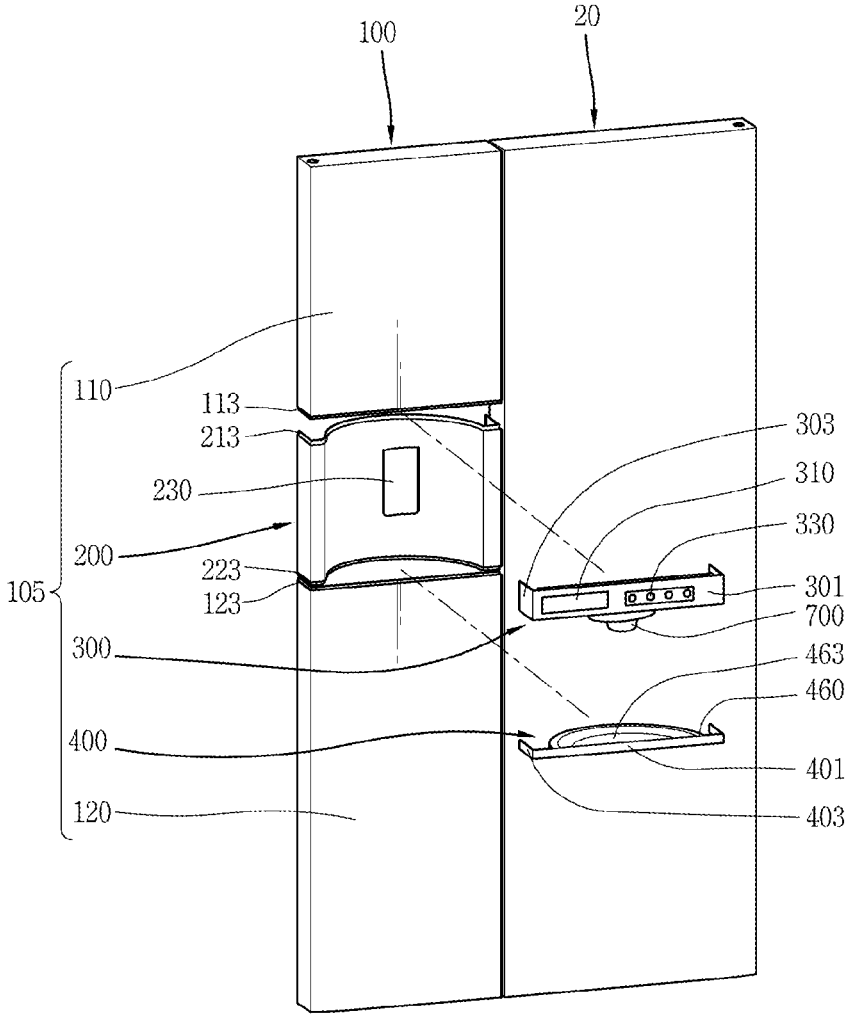
FIG. 4 is a view illustrating example upper and lower connection members installed in the refrigerator door of FIG. 3.
Figure 5:
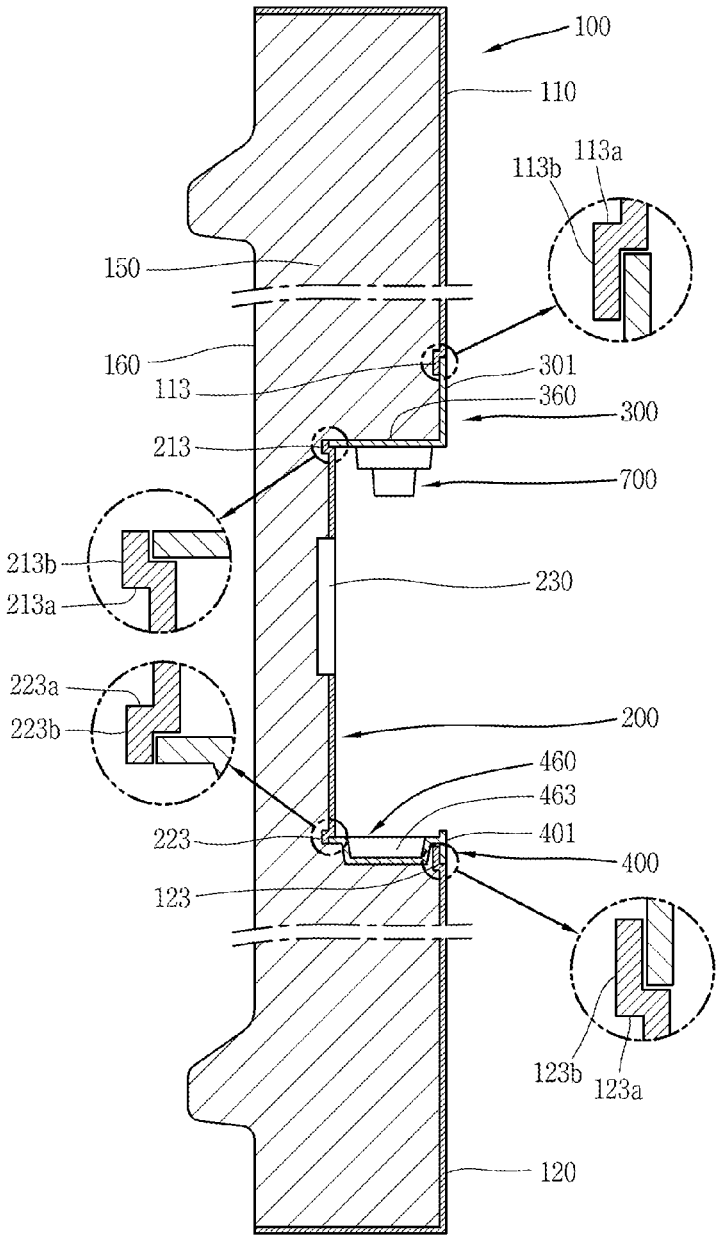
FIG. 5 is a cross-sectional view of the refrigerator door of FIG. 3.

As illustrated in FIGS. 3 through 5, an example door 100 for an example refrigerator has a dispenser for dispensing water or ice kept therein without having to open the door. The door 100 includes an example outer door case 105. The outer door case 105 includes an upper door member 110 defining an upper portion of a refrigerator door; a lower door member 120 defining a lower portion of the refrigerator door; a dispenser housing 200 positioned between the upper door member 110 and the lower door member 120 and inwardly depressed to accommodate a dispenser having a discharge duct 700 for discharging water or ice; and coupling members 300 and 400 fastening the dispenser housing 200 between the upper door member 110 and the lower door member 120.

The coupling members 300 and 400 include an upper connection member 300 fastened between the upper door member 110 and the dispenser housing 200 and a lower connection member 400 fastened between the lower door member 120 and the dispenser housing 200.

Also, the dispenser housing 200 may include an actuator pad 230 that allows a user to press or touch the pad 230to cause dispensing of water or ice.

As illustrated in FIGS. 3 through 5, the dispenser for dispensing water or ice is installed in the dispenser housing 200, and the actuator pad 230 is installed at the dispenser housing 200 as an ice and water supply switch to be manipulated by the user. When the user operates the actuator pad 230, an ice maker or a water storage tank installed in the refrigerator is opened and ice or purified water is dispensed from a dispensing hole connected to the ice maker and/or the water storage tank to the outside through the discharge duct 700.

The discharge duct 700 is positioned on the ceiling of the depressed portion of the dispenser housing 200 in which the dispenser is installed, and the actuator pad 230 may protrude downwardly from an end portion of the dispensing hole connected to the ice maker or the water storage tank, or may be positioned at an inner surface of the depressed portion close to the dispensing hole. When the user inwardly pushes or presses the actuator pad 230 with a cup, water or ice is dispensed from the discharge duct 700.

For example, in the case in which the actuator pad 230 downwardly protrudes from an upper surface of the depressed portion, if the user wants to drink water, the user may push or touch the actuator pad 230 with a cup. Then, water stored in the water storage tank or ice stored in an ice bank may be dispensed from the discharge duct 700 positioned in front of an upper portion of the actuator pad 230, so as to be supplied into the cup.

Referring to FIG. 4, the upper door member 110 and the lower door member 120 may be made of the same material. For example, the upper door member 110 may include a metal plate having the exterior in a pre-set color. The lower door member 120 may include a metal plate that has the same color as that of the upper door member 110. The upper door member 110 and the lower door member 120 may be fabricated at the same time through pressing in the same mold.

The dispenser housing 200 may be formed by molding a metal plate that has the same color as that of the upper door member 110.

For instance, the upper door member 110, the lower door member 120, and the dispenser housing 200 may be fabricated at the same time through pressing in the same mold, The upper door member 110 and the lower door member 120 may have a flat vertical plane, and the dispenser housing 200 may have a bent vertical plane. In particular, as illustrated in FIG. 4, the dispenser housing 200 may have a backward cylindrically depressed stand surface. Thus, the outer door case 105 of the refrigerator may be fabricated by performing press working on a single iron plate (preferably, stainless steel) in a single mold in which upper and lower portions have a planar shape and a middle portion is cylindrically bent, such that the three parts are fabricated at the same time. Of course, the upper door member 110, the lower door member 120, and the dispenser housing 200 may also be separately fabricated.

The upper door member 110, the lower door member 120, and the dispenser housing 200 may be fabricated with stainless steel as the same material through pressing. Accordingly, an integrated stainless texture may be achieved to enhance aesthetics. Also, the dispenser housing 200 may be restrained from being scratched or damaged, relative to an existing plastic material. Also, the dispenser housing 200 may have enhanced cleaning performance based on a lower likelihood of being contaminated by foreign objects.

A process of forming the outer door case 105 of the refrigerator by coupling the upper door member 110, the lower door member 120, and the dispenser housing 200 is described below. The upper connection member 300 is fastened between the upper door member 110 and the dispenser housing 200, and the lower connection member 400 is fastened between the dispenser housing 200 and the lower door member 120 to fabricate a completed outer door case 105.

Figure 6:
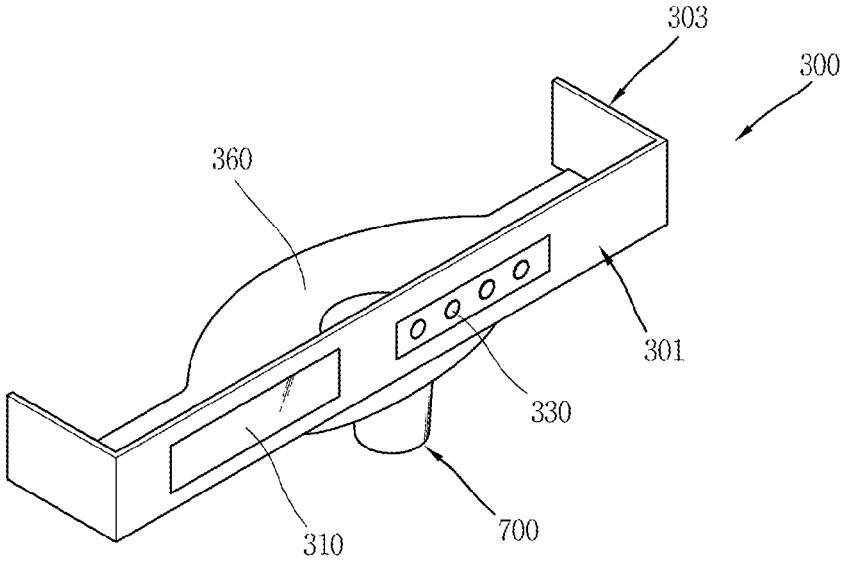
FIG. 6 is a perspective view of the upper connection member of FIG. 3.

Referring to FIGS. 5 and 6, the upper connection member 300 has a front surface portion 301 and a side wall portion 303 that correspond to a lower end of the upper door member 110, and configured to fasten to the upper door member 110. The upper connection member 300 may have a first housing coupling portion 360 in a lower portion thereof. An upper end of the dispenser housing 200 may be coupled to the first housing coupling portion 360.

The upper connection member 300 may include a display unit 310 that displays a dispensed state of water or ice and a dispensed amount; a button unit 330 that allows the user to manipulate a dispenser function to dispense water or ice; and the first housing coupling portion 360 coupled to the dispenser housing 200.

The display unit 310 may variously display functions and states of the dispenser. For example, the display unit 310 may display various numeral values indicating whether to dispense water or ice, a temperature of water, a pre-set water dispensing amount, a pre-set dispensing amount of ice, a current amount of stored water or ice, a current temperature, and the like.

The button unit 330 may allow the user to set and input an operation function of the dispenser upon checking a value displayed on the display unit 310. For example, the user may adjust and input a water or ice selection function, a temperature setting function, a dispensing amount setting function, or the like, through the button unit 330.

As illustrated in FIG. 6, the first housing coupling portion 360 has a shape of a backwardly curved plate. The first housing coupling portion 360 may be assembled to correspond to the depressed stand surface of the dispenser housing 200 fastened from a lower side as illustrated in FIG. 5. The discharge duct 700 may be installed on a lower surface of the first housing coupling portion 360 to dispense water or ice.

The first housing coupling portion 360 may include the discharge duct 700 and may define an upper ceiling of the dispenser. The discharge duct 700 protrudes downward such that ice or water can be dispensed downwardly from an ice maker or a water storage tank positioned within the refrigerator.

Figure 7:
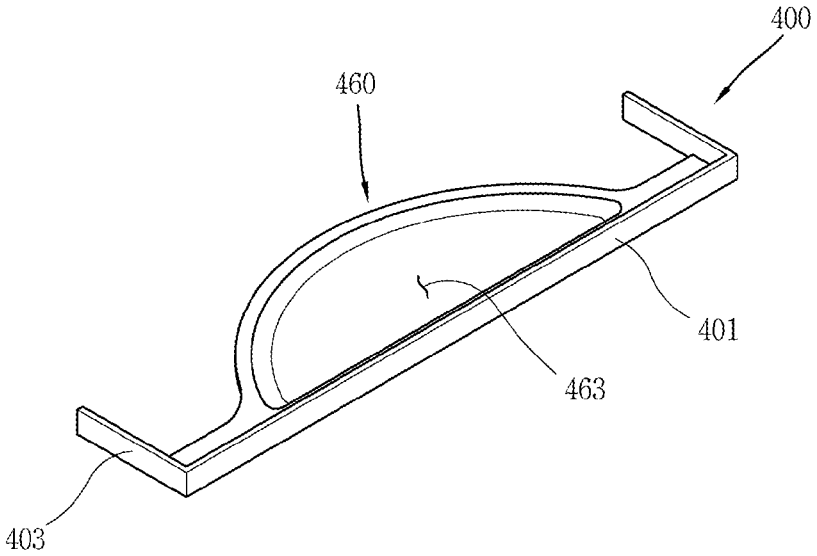
FIG. 7 is a perspective view of the lower connection member of FIG. 3.

Referring to FIGS. 5 and 7, the lower connection member 400 may have a front surface portion 401 and a side wall portion 403 which correspond to an upper end of the lower door member 120. The front surface portion 401 and the side wall portion 403 of the lower connection member 400 may be configured to fasten and be assembled to the lower door member 120. The lower connection member 400 may have a second housing coupling portion 460 at an upper portion thereof. The second housing coupling portion 460 may be coupled to a lower end portion of the dispenser housing 200.

Like the first housing coupling portion 360 of the upper connection member 300 as described above, the second housing coupling portion 460 may be provided as a plate that is backwardly curved.

The second housing coupling portion 460 may include a residual water receiving portion 463 formed to be downwardly depressed to keep residual water of the dispenser. The residual water receiving portion 463 may be formed as a water collecting portion formed to be concave in a lower portion of the dispenser The residual water receiving portion 463 serves to collect residual water flowing from a gap opened during a short period of time before the discharge duct 700 is completely closed when the cup is removed after using the dispenser. For instance, the residual water receiving portion 463 may prevent residual water from flowing to the bottom of a place in which the refrigerator is installed.

In some implementations, the upper connection member 300 may be, for example, a synthetic resin member. The lower connection member 400 may be, for example, a synthetic resin member. The upper connection member 300 may be fabricated, for example, by injection-molding a synthetic resin member. The lower connection member 400 may be fabricated, for example, by injection-molding a synthetic resin.

In some examples, a refrigerator having the door for a refrigerator including the upper door member 110, the lower door member 120, and the dispenser housing 200 as described above is provided.

As shown in FIG. 3, a refrigerator includes a refrigerator body 1 having a refrigerating chamber 92 and a freezing chamber 91; a refrigerator chamber door 20 opening and closing the refrigerating chamber 92, and a freezing chamber door 100 opening and closing the freezing chamber 91. The freezing chamber door 100 includes the upper door member 110 at an upper portion; the lower door member 120 at a lower portion; the upper connection member 300 fastened between the upper door member 110 and the dispenser housing 200; and the lower connection member 400 fastened between the lower door member 120 and the dispenser housing 200.

FIG. 5 illustrates assembly of the door of the refrigerator and vertical plane characteristics thereof. First, as illustrated in FIG. 5, referring to a cross-section of the door 100, the door 100 includes the upper door member 110, the lower door member 120, and the dispenser housing 200 each having a predetermined thickness and defining the outer door case 105, and an insulator 150 provided within the upper door member 110, the lower door member 120, and the dispenser housing 200. The door 100 includes a door liner (e.g., an inner door case) 160 in contact with the refrigerating chamber 92 or the freezing chamber 91. For example, the door 100 includes the outer door case 105 having the upper door member 110, the lower door member 120, and the dispenser housing 200, the door liner 160 disposed at an inner side of the outer door case 105 and spaced apart from the outer door case 105, and the insulator 150 positioned between the outer door case 105 and the door liner 160.

The outer door case 105 may be fabricated by assembling the upper door member 110, the lower door member 120, and the dispenser housing 200 with the upper connection member 300 and the lower connection member 400.

As for portions assembled by the upper connection member 300, the upper door member 110 includes a coupling step 113 on a lower end portion thereof and bent inwardly, and a coupling step 213 on an upper end portion of the dispenser housing 200 and bent inwardly, so that an upper edge of the first housing coupling portion 360 and the upper connection member 300 are inwardly inserted into the bent portions of the coupling steps 113 and 123 so as to be coupled. For instance, the coupling step 113 in a lower end of the upper door member 110 is inserted to be in contact with an inner surface of the upper end portion of the upper connection member 300, and the coupling step 213 in an upper end portion of the dispenser housing 200 is insertedly coupled to be in contact with the edge of the first housing coupling portion 360.

As for portions assembled by the lower connection member 400, a coupling step 123 is provided in an upper end portion of the lower door member 120 and inwardly bent, and a coupling step 223 is provided in a lower end portion of the dispenser housing 200 and inwardly bent, so that a lower edge of the lower connection member 400 and the second housing coupling portion 460 are inwardly inserted into the bent portions of the coupling steps 123 and 223 so as to be coupled. For instance, the coupling step 223 of the lower end portion of the dispenser housing 200 may be inwardly inserted so as to be in contact with an inner edge of the second housing coupling portion 460 of the lower connection member 400, and the lower door member 120 may be inserted such that a rear surface of a lower edge of the lower connection member 400 and the coupling step 123 of the lower door member 120 are in contact with each other. The respective coupling steps 113, 123, 213, and 223 may have horizontal sections 113*a*, 123*a*, 213*a*, and 223*a* bent to be protruded backwardly and vertical sections 113*b*, 123*b*, 213*b*, and 223*b* bent vertically from the horizontal sections 113*a*, 123*a*, 213*a*, and 223*a*, respectively. The horizontal sections 113*a*, 123*a*, 213*a*, and 223*a* of the coupling steps 113, 123, 213, and 223 may have, for example, a length corresponding to a thickness of the upper door member 110, the lower door member 120, and the dispenser housing 200, respectively. Accordingly, when the upper door member 110, the lower door member 120, and the dispenser housing 220 are coupled by the upper connection member 300 and the lower connection member 400, the respective outer surfaces thereof may be disposed in the same vertical plane and stably supported in a vertical direction. The length of the respective vertical sections 113*b*, 123*b*, 213*b*, and 223*b* may be appropriately adjusted.

Accordingly, the surfaces of the upper door member 110 and the upper connection member 300 and the surfaces of the lower door member 120 and the lower connection member 400 may be oriented in the same vertical plane. Also, since the upper door member 110, the lower door member 120, and the dispenser housing 200 are metal members having the same color, an exterior appearance may be consistent, and contamination by foreign objects may be reduced to enhance cleaning characteristics.

Figure 8:
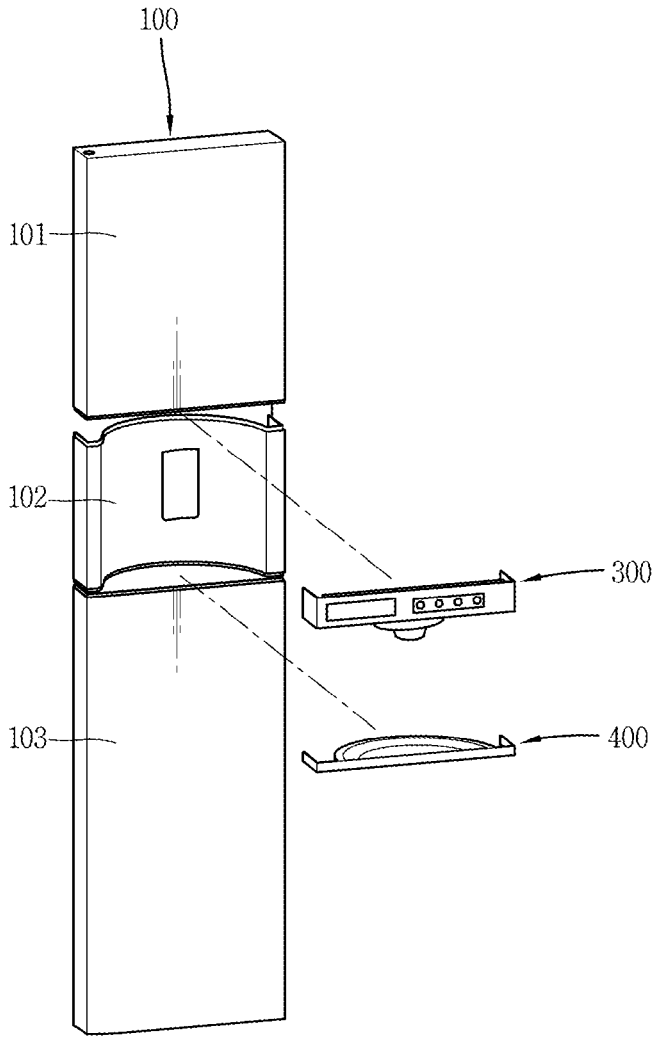
FIG. 8 is a perspective view illustrating another example door for a refrigerator.

FIG. 8 illustrates an example door 100 for a refrigerator. The door 100 includes a first door member 101 positioned in an upper portion and having a flat front vertical plane; a second door member 102 positioned in a middle portion and having an inwardly depressed and bent vertical plane and having a dispenser installed therein to dispense water or ice to serve as a dispenser housing; and a third door member 103 positioned in a lowermost portion and having a flat front vertical plane. An outer door case of the door 100 includes the first door member, the second door member, and the third door member and the first door member, the second door member, and the third door member may be fabricated at the same time by performing pressing on a single member in a single mold.

Thus, the first door member 101, the second door member 102, and the third door member 103 may be made of the same stainless material, implementing a unified texture and reducing a possibility of being scratched or damaged.

As described above, in the door for a refrigerator having a dispenser for dispensing ice or water, the upper door member, the lower door member, and the dispenser housing may be separately fabricated, or the upper door member, the lower door member, and the dispenser housing may be fabricated through a single operation and assembled, thereby facilitating the fabrication process and realizing a relatively simple structure.

Also, since the upper door member, the lower door member, and the dispenser housing are made of the same material such as a stainless steel, or the like, and coupled with the upper connection member and the lower connection member such that they have the same vertical planar surface, a unified texture may be achieved, aesthetic touch may be enhanced, the possibility of being scratched and damaged may be reduced, and contamination by foreign objects may be reduced.

The foregoing implementations are merely exemplary and are not to be considered as limiting the present disclosure. The present teachings may be readily applied to other types of apparatus. This description is intended to be illustrative, and not to limit the scope of the claims. Alternatives, modifications, and variations will be apparent to those skilled in the art. The features, structures, methods, and other characteristics of the examples described herein may be combined in various ways to obtain additional and/or alternative examples.

As the present features may be adapted without departing from the characteristics thereof, it should also be understood that the above-described implementations are not limited by any of the details of the foregoing description, unless otherwise specified, but rather should be considered broadly within its scope as defined in the appended claims. Therefore, changes and modifications that fall within the metes and bounds of the claims, or equivalents of such metes and bounds, are intended to be covered by the appended claims.

What is claimed is:

1. A door for a refrigerator comprising:

an outer door case;

a door liner coupled to an inner side of the outer door case; and an insulator positioned in a space between the outer door case and the door liner, the outer door case comprising:

an upper door member that includes a first metal plate of a first color;

a lower door member that includes a second metal plate of the first color;

a dispenser housing that includes a third metal plate of the first color;

an upper connection member that is made of synthetic resin and that connects the upper door member and the dispenser housing; and a lower connection member that is made of synthetic resin and that connects the lower door member and the dispenser housing, wherein surfaces of the upper door member and the upper connection member and surfaces of the lower door member and the lower connection member are configured to be disposed in the same vertical plane, wherein the upper door member has a first coupling step that is positioned in a lower end portion thereof and that is inwardly bent, wherein the dispenser housing has a second coupling step that is positioned in an upper end portion thereof and that is inwardly bent, wherein an upper edge of the upper connection member inserts into the first coupling step, and wherein a lower edge of the upper connection member inserts into the second coupling step.

2. The door for a refrigerator of claim 1, wherein the upper connection member includes a first housing coupling portion that is provided in a lower portion of the upper connection member and that is configured to couple to the dispenser housing.

3. The door for a refrigerator of claim 2, wherein the upper connection member comprises:

a display unit configured to display at least one of dispensing information and information related to operation of the refrigerator; and an input unit configured to receive user input that controls at least one of dispensing operation and operation of the refrigerator.

4. The door for a refrigerator of claim 2, wherein the first housing coupling portion includes a discharge duct from which at least one of water and ice is dispensed.

5. The door for a refrigerator of claim 1, wherein the lower connection member includes a second housing coupling portion configured to couple to a lower portion of the dispenser housing.

6. The door for a refrigerator of claim 5, wherein the second housing coupling portion includes a residual water receiving portion that is depressed downwardly and configured to collect residual water of the dispenser.

7. The door for a refrigerator of claim 1:

wherein the lower door member has a third coupling step that is positioned in an upper end portion thereof and that is inwardly bent, wherein the dispenser housing has a fourth coupling step that is positioned in an lower end portion thereof and that is inwardly bent, wherein a lower edge of the lower connection member inserts into the third coupling step, and wherein an upper edge of the upper connection member inserts into the fourth coupling step.

8. The door for a refrigerator of claim 1, wherein the dispenser housing includes an actuator pad configured to receive input that controls dispensing of ice or water.

9. A refrigerator comprising:

a refrigerator body that defines a refrigerating chamber and a freezing chamber;

a refrigerating chamber door configured to open and close the refrigerating chamber; and a freezing chamber door configured to open and close the freezing chamber, the freezing chamber door comprising:

an outer door case;

a door liner coupled to an inner side of the outer door case; and an insulator positioned in a space between the outer door case and the door liner, the outer door case comprising:

an upper door member that includes a first metal plate of a first color;

a lower door member that includes a second metal plate of the first color;

a dispenser housing that includes a third metal plate of the first color;

an upper connection member that is made of synthetic resin and that connects the upper door member and the dispenser housing; and a lower connection member that is made of synthetic resin and that connects the lower door member and the dispenser housing, wherein surfaces of the upper door member and the upper connection member and surfaces of the lower door member and the lower connection member are configured to be disposed in the same vertical plane, wherein the upper door member has a first coupling step that is positioned in a lower end portion thereof and that is inwardly bent, wherein the dispenser housing has a second coupling step that is positioned in an upper end portion thereof and that is inwardly bent, wherein an upper edge of the upper connection member inserts into the first coupling step, and wherein a lower edge of the upper connection member inserts into the second coupling step.

10. The refrigerator of claim 9, wherein the upper door member, the lower door member, and the dispenser housing are made of the same stainless material.

11. The refrigerator of claim 9, wherein the upper connection member includes a first housing coupling portion that is provided in a lower portion of the upper connection member and that is configured to couple to the dispenser housing.

12. The refrigerator of claim 9, wherein the lower connection member includes a second housing coupling portion configured to couple to a lower portion of the dispenser housing.

13. The refrigerator of claim 12, wherein the second housing coupling portion includes a residual water receiving portion that is depressed downwardly and configured to collect residual water of the dispenser.

14. The refrigerator of claim 9:

wherein the lower door member has a third coupling step that is positioned in an upper end portion thereof and that is inwardly bent, wherein the dispenser housing has a fourth coupling step that is positioned in an lower end portion thereof and that is inwardly bent, wherein a lower edge of the lower connection member inserts into the third coupling step, and wherein an upper edge of the upper connection member inserts into the fourth coupling step.

* * * * *